United States Patent [19]

Zwier et al.

[11] Patent Number: 4,717,855

[45] Date of Patent: Jan. 5, 1988

[54] DUAL-CATHODE ELECTRON EMISSION DEVICE

[75] Inventors: Jan Zwier, Eindhoven; Johannes H. A. Vasterink, Almelo, both of Netherlands

[73] Assignee: U.S. Philips Corporation, New York, N.Y.

[21] Appl. No.: 832,952

[22] Filed: Feb. 26, 1986

[30] Foreign Application Priority Data

Mar. 4, 1985 [NL] Netherlands ..... 8500596

[51] Int. Cl.[4] ..... H01J 19/24

[52] U.S. Cl. ..... 313/409; 313/346 R; 313/446

[58] Field of Search ..... 313/446, 409, 422, 346 R

[56] References Cited

U.S. PATENT DOCUMENTS 4,160,188 7/1979 Butterwick ..... 313/446
4,574,216 3/1986 Hoeberechts ..... 313/446 X

FOREIGN PATENT DOCUMENTS 2117173 10/1983 United Kingdom ..... 313/446

*Primary Examiner*—Palmer C. DeMeo
*Attorney, Agent, or Firm*—Robert T. Mayer; Steven R. Biren

[57] ABSTRACT

The efficiency of a semiconductor cathode can be increased by bombarding the electron-emitting regions (8) with an electron beam (8), which frees the surface from adhered oxygen particles. The electron beam preferably originates from a second semiconductor cathode (42), which has an opening (42) for passing the electron beam (20) of the first semiconductor cathode (20). Alternatively, both semiconductor cathodes can be realized in one semiconductor body.

20 Claims, 8 Drawing Figures

DUAL-CATHODE ELECTRON EMISSION DEVICE

BACKGROUND OF THE INVENTION

The invention relates to an arrangement comprising an evacuated space or a space filled with an inert gas and a semiconductor device for producing an electron beam with a first cathode comprising a semiconductor body having at a major surface at least one region which emits electrons in the operating condition.

The invention further relates to semiconductor devices for use in such an arrangement.

An arrangement of the kind mentioned above is known from Netherlands patent application No. 7905470 laid open to public inspection on Jan. 15, 1981. This Application discloses a cold cathode, whose operation is based on avalanche multiplication of electrons when a pn junction is reverse-biased. The pn junction, at the area of the emitting surface, has a reduced breakdown voltage and is separated in situ from the surface by an n-type conducting layer having such a thickness and doping concentration that at the breakdown voltage the depletion zone does not extend as far as the surface, but remains separated therefrom by a surface layer which is sufficiently thin to transmit the generated electrons.

In order to reduce the work function for the electrons generated in the semiconductor body, the emitting surface is generally coated with a material reducing the work function, such as, for example, caesium or barium.

Such cathodes are generally used in vacuum tubes for recording or reproducing purposes, but may also be used in apparatus for Auger spectroscopy, electron microscopy and electron lithography. In addition to reverse-biased junction cathodes, varius other kinds of semiconductor cathodes are possible, such as, for example, NEA cathodes and field emitters.

These cathodes or semiconductor devices, in which these cathodes are integrated, are arranged after their manufacture in, for example, cathode-ray tubes or other kinds of vacuum spaces. Although this operation is carried out with great care, a light oxidation may nevertheless occur, for example, during transport. Furthermore, after such a cathode has been mounted, the concentration of oxygen atoms at the emitting surface of this cathode may increase further due to interactions of the surface layer with residual gases from the vacuum system. The presence of oxygen atoms in bound form or adsorbed at the emitting surface leads to a considerable decrease of the emission efficiency.

SUMMARY OF THE INVENTION

The invention has for its object to provide an arrangement, in which such a decrease in efficiency can be obviated entirely or in part.

An arrangement according to the invention is characterized for this purpose in that the arrangement comprises a second electron source for generating electrons which strike the major surface of the semiconductor body at least at the area of the electron-emitting region.

The invention is based on the recognition of the fact that the surface concentration of oxygen atoms at the electron-emitting surface, as the case may be in bound form, can be considerably reduced by bombarding this surface with electrons. Depending upon the duration of the bombardment, the energy and the density of the electrons used for the bombardment, improvements in efficiency of up to a factor of 50 are obtained in emitters with a reverse-biased pn junction coated with caesium.

The bombardment can take place after the cathode has been mounted in the evacuated space in order to eliminate any decrease in efficiency occurring during transport of mounting. Furthermore, a cathode exhibiting a decrease in efficiency during operation, for example, by adsorption of oxygen atoms present in the residual gases of the vacuum system can be effectively regenerated by means of such a bombardment.

The electron beam generated for this bombardment can be directed onto the cathode to be regenerated by conventional focusing and control means. Preferably, these control means can be adjusted so that they can concentrate the electrons generated by the second electron source in a bea which mainly strikes the electron-emitting region.

As a second electron source, in principle a conventional electron source can be chosen, such as, for example, a thermionic cathode containing barium or strontium as a cathode material. However, during use, carbon dioxide compounds ($CO$, $CO_2$) and carbon hydroxyde compounds can be released, of which residual products can adhere to the electron-emitting surface or can form compounds with the monomolecular caesium layer, which gives rise to a decrease in efficiency of the semiconductor cathode.

Therefore, the arrangement according to the invention is preferably provided on behalf of the second electron source with a semiconductor device comprising a second cathode having a semiconductor body provided at a major surface with at least one region, which emits electrons in the operating condition.

A preferred embodiment of such an arrangement is characterized in that the first cathode and the second cathode face each other with their major surfaces and the semiconductor body, in which the second cathode is formed, is provided with an opening for passing the electrons generated by the first cathode.

Although less stringent requirements are imposed on the emission efficiency of the second cathode with respect to absolute value and stability over time, this second cathode can in the same manner be again bombarded with electrons originating from the first cathode to restore the emission efficiency. For this purpose, the first cathode may be extended, if desired, with an emitting region which is specifically intended therefore and can be separately switched on or which emits under different operating conditions, for example, by giving in the case of a reverse-biased junction cathode the associated pn junction a higher breakdown voltage.

It is alternatively possible to realize both cathodes in one semiconductor body, which can again be mounted in the usual manner in a cathode-ray tube. In this case, use may be made of an ion trap of the kind described in the non-prepublished Netherlands patent application No. 8403537.

Finally, for higher stability, the emission can be produced by means of a number of small emission regions arranged in accordance with a given pattern, as described in the non-prepublished Netherlands patent application No. 8403538.

BRIEF DESCRIPTION OF THE DRAWING

The invention will now be described more fully with reference to several embodiments and the drawing, in which.

Figure 1:
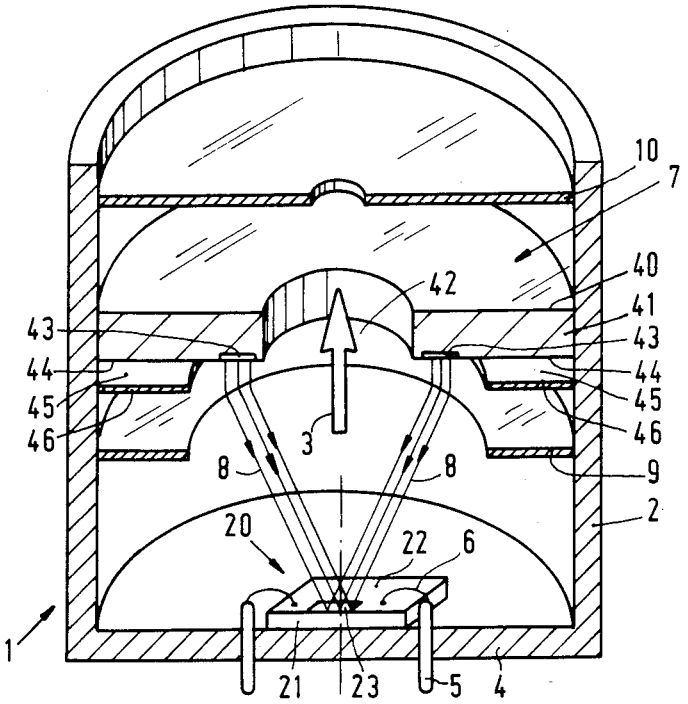
FIG. 1 shows diagrammatically, partly in cross-section and partly in perspective view, an arrangement according to the invention.

The Figures are not drawn to scale, and in the cross-sections the dimensions in the direction of thickness are greatly exaggerated. Semiconductor zones of the same conductivity type are generally cross-hatched in the same direction and corresponding parts are generally designated by the same reference numerals.

DESCRIPTION OF THE PREFERRED EMBODIMENTS

FIG. 1 shows partly in the cross-section and partly in perspective view an arrangement 1 according to the invention, in this embodiment an evacuated cathode-ray tube 2. The latter comprises for producing an electron current 3 a first cathode 20, which in this embodiment is constituted by a semiconductor body 21, having at the major surface 22 a region 23 which emits electrons in the operating condition. The cathode 20 is then mounted on an end wall 4 of the cathode-ray tube 2, this end wall being provided with lead-through members 5 for connecting by means of wire connections 6 the cathode 20 and other elements in the evacuated space, such as acceleration grids, deflection plates, etc.

According to the invention, the arrangement further comprises a second electron source, in this embodiment also a semiconductor cathode, for generating a second electron current 8, which strikes the major surface 22 of the first semiconductor cathode 20 at the area of the electron-emitting region 23. A grid 9, which is already present, for example, for accelerating or focusing the electron current 3, can be electrically biased in such a manner that the beam 8 is controlled and focused so that it mainly strikes the electron-emitting region 23.

The second semiconductor cathode 40 comprises a semiconductor body 41 with an opening 42 for passing the electron current 3 and is provided with an electron-emitting region 43, which in this embodiment is circular and substantially entirely surrounds the opening 42. In the present embodiment, the cathodes, which will be described more fully hereinafter, are of the reverse-biased pn junction type as described in the aforementioned Netherlands patent application No. 7905470. The electron-emitting region 43 is situated at a major surface 44 of the semiconductor body 41, this surface facing the end wall 4 of the cathode-ray tube 2. This major surface 44 is covered in the present embodiment with an electrically insulating layer 45, which leaves free the electron-emitting regions 43 and on which an acceleration electrode 46 is provided. The opening 42 is situated, viewed in projection at right angles to the surface 44, opposite to the electron-emitting region 23.

As described more fully in Netherlands patent application No. 8403537, the electron-emitting region 23 of the first cathode 20 can be chosen so that the electron emission takes place in an annular pattern, the cathode, a first grid and a screen grid forming a positive electron lens. By suitably chosen design and dimensions of the screen grid and the electron-emitting region 23, respectively (for example, a circular form), it can then be achieved that the emission region 23 is struck only by positive ions generated in a small region between the cathode 20 and a first grid, for example, the control grid 9. These ions have a comparatively low energy so that the emission behavior is substantially not adversely affected by any sputtering of positive ions from cathode material, such as, for example, a vapor-deposited layer 59 of caesium. Under given circumstances, the second cathode 40 may then act as a screen grid; it may then be metallized, for example, on the lower side (i.e. the side remote from the major surface 44). Furthermore, if the electron current generated by the cathode 20 forms a cross-over between the cathode 40 and the second end wall (not shown), an additional screen grid 10 may be provided at the area of this cross-over.

In the normal operating condition, the adjustment of the cathode 20 is such that electrons are generated by the electron-emitting region 23, which gives rise to an electron current 3. Any oxygen residues (molecules, atoms or ions) left in the cathode-ray tube 2 or released during use can adhere there gradually to the surface 22 or can react with it. A light oxidation can also take place before or during mounting of the semiconductor cathode 20. The presence of (as the case may be chemically bound) oxygen molecules, atoms or ions gives rise to decrease in efficiency.

In order to eliminate or reduce this decrease in efficiency, the surface 22 can be bombarded at the area of the electron-emitting region 23 by electrons originating from the cathode 40. The semiconductor cathode 40 is then biased so that an electron beam 8 is obtained. The oxygen atoms or molecules present on the surface 22 are removed by means of the electron bombardment and the efficiency of the semiconductor cathode 20 is increased again to the original value within a reasonable time duration (½ to 2 hours) (regeneration) or is even improved (ab initio) by a factor of about 50, depending upon the intensity of the bombardment.

Figure 2:
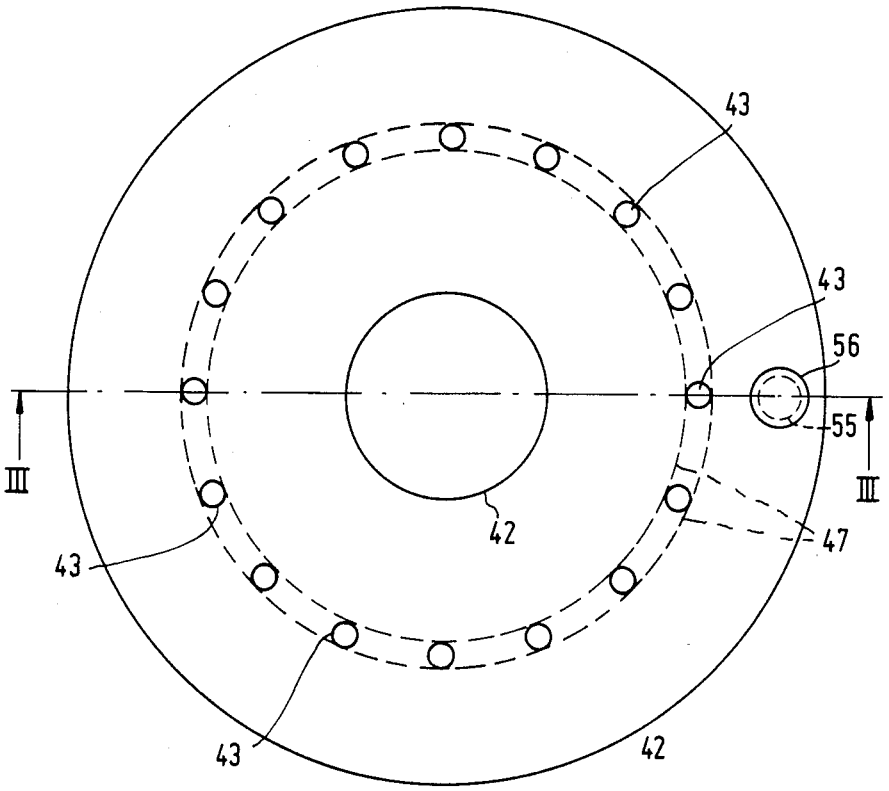
FIG. 2 shows diagrammatically in plan view a second cathode for use in such an arrangement.
Figure 3:
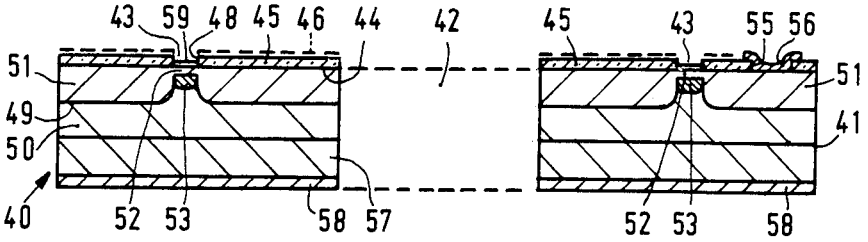
FIG. 3 shows a cross-section taken on the line III—III in FIG. 2.

The semiconductor device 40 of FIGS. 2 and 3 comprises a semiconductor body 41 of silicon having at a major surface 44 a number of emission regions 43, which in this embodiment are arranged in an annular pattern indicated in FIG. 2 by the broken lines 47. The actual emission regions 43 are situated at the area of openings 48 in an insulating layer 45 of, for example, silicon oxide.

The semiconductor device has a pn junction 49 between a p-type substrate 50 and an n-type zone 51,52 consisting of a deep n-zone 51 and a shallow zone 52. At the area of the emission regions 43, the pn junction is situated between an implanted p-type region 53 and the shallow zone, which in situ has such a thickness and doping that at the breakdown voltage of the pn junction 49 the depletion zone of the pn junction does not extend as far as the surface, but remains separated therefrom by a surface layer which is sufficiently thin to transmit electrons generated due to breakdown. Due to the highly doped p-type region 53, the pn junction has within the openings 48 a low breakdown voltage so that the electron emission takes place practically solely in the regions 43 at the area of the openings 48. Furthermore, the arrangement can be provided with an electrode 46, with which the generated beam 8 may be deflected or modulated, if desired. The semiconductor body has an opening 42 within the annular pattern 47 for passing electrons generated by the cathode 20.

For contacting the n-type zone 51, a contact hole 55 is provided in the oxide layer 45 for a contact metallization 56, while on the lower side the substrate 50 can be connected via a highly doped p-type zone 57 and a contact metallization 58. Within the openings 48, a monolayer 59 of, for example, caesium is formed on the surface 44 in order to reduce the work function for the electrons.

For a further description of the structure, the operation and the method of manufacturing the semiconductor device shown in FIGS. 2 and 3, reference may be made to the Netherlands patent application No. 7905470.

The advantages of the subdivision of the emission pattern 47 into several regions 43 are described more fully in the non-prepublished Netherlands patent application No. 8403538.

Figure 4:
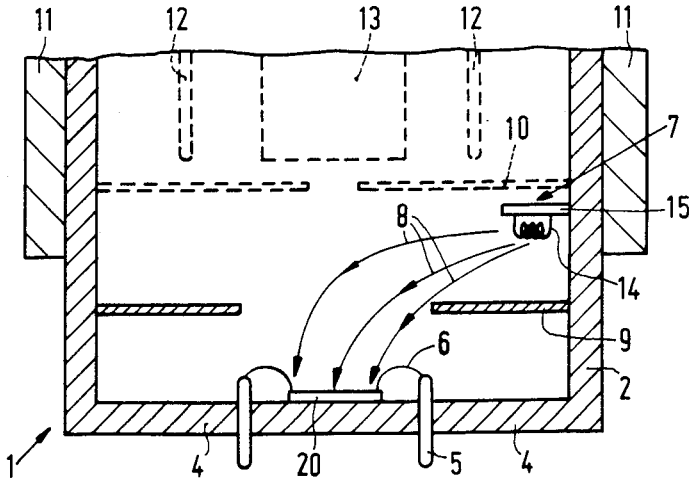
FIG. 4 shows diagrammatically another arrangement according to the invention.

The electrons for the electron bombardment on the cathode 20 can also be obtained by means of a thermionic cathode. FIG. 4 shows an arrangement 1 comprising a cathode-ray tube 2, which has a semiconductor cathode 20 and is further provided with the usual electromagnetic deflection means 11. Instead of the deflection means 11, horizontal deflection plates 12 and vertical deflection plates 13 (shown diagrammatically) may also be used. The electron beam 8 for the electron bombardment is now supplied by a second electron source 7, which consists of a thermionic cathode 14 mounted on a holder 15. By means of suitable voltages at the cathodes 14,20 and the control grid 9, the electron beam 8 can be deflected so that it strikes the electron-emitting surface of the cathode 20.

The use of a semiconductor cathode as a second electron source has various advantages, however. First, no carbon dioxide or carbon hydroxide compounds are released, whereas this is the case when using thermionic cathodes. Moreover, when using a semiconductor cathode as a second electron source (cf. FIG. 3), any decrease in efficiency of the cathode 40 can be eliminated again by an electron bombardment by the electron beam 3 originating from the cathode 20, which beam then strikes the electron-emitting regions 43. If required, in order to increase the intensity of the electron beam 3, one or more additional emission regions may be provided in the semiconductor body 21, which regions surround, for example, the electron-emitting region 23 and have a higher breakdown voltage so that in these regions no electron emission occurs under normal operating conditions.

Figure 5:
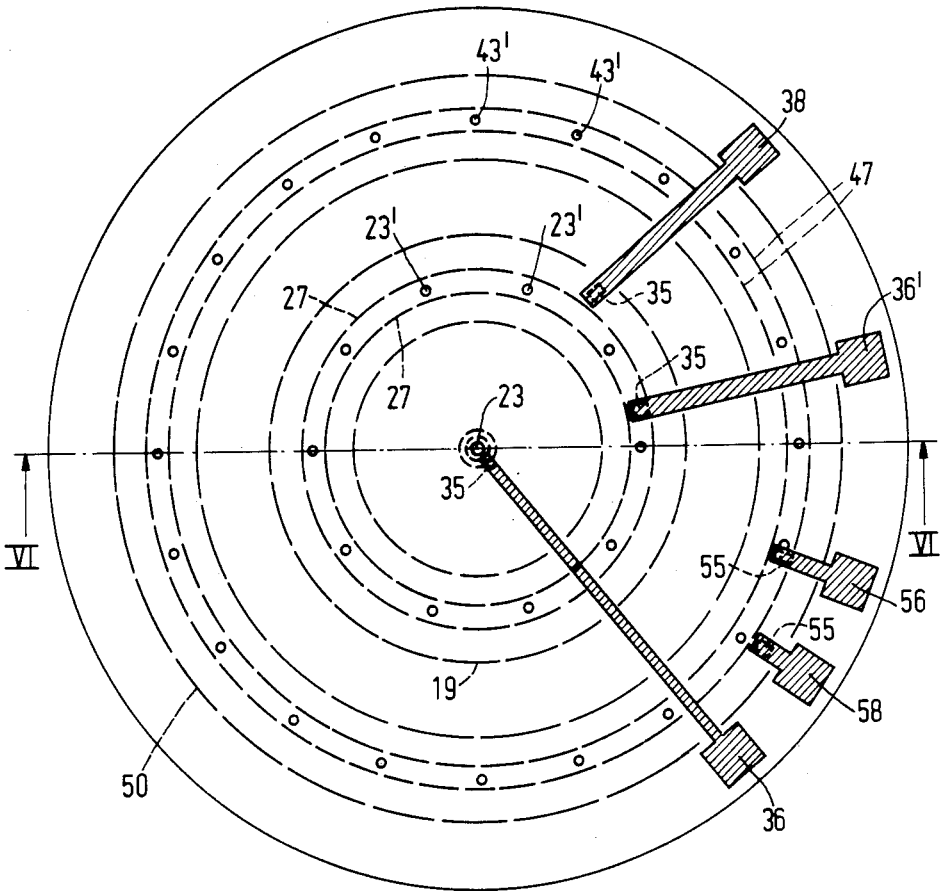
FIG. 5 shows diagrammatically in plan view a semiconductor device comprising the first and second cathodes.
Figure 6:
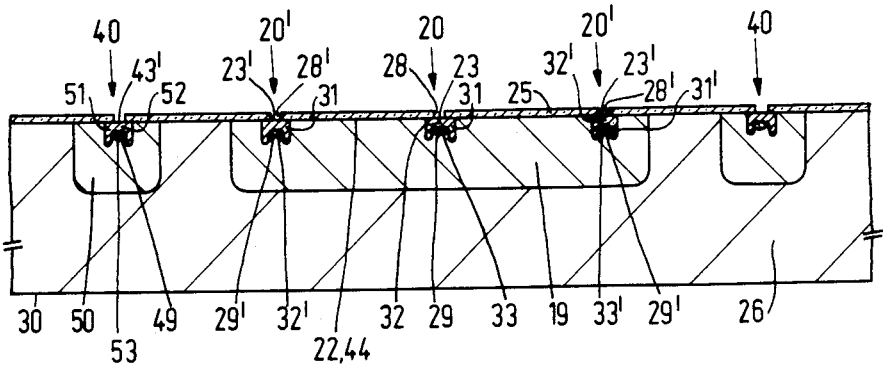
FIG. 6 shows a cross-section taken on the line VI—VI in FIG. 5.

FIGS. 5 and 6 show a semiconductor body 30, in which the first cathode 20 and the second cathode 40 are realized together. The first cathode 20 has a substantially circular electron-emitting region 23 having a cross-section of about 1 μm. This region is surrounded by an additional cathode 20', which emits according to a substantially annular pattern indicated by broken lines 27 and comprises a number of emitting regions 23'. The annular pattern has a diameter of about 30 μm, while that of the regions 23' is about 1 μm.

The semiconductor body 30 has for the cathodes 20, 20' and 40, an n-type substrate 26, in which p-type regions 19 and 50 are provided. In the p-type region 19 are provided the cathodes 20 and 20', whose construction is substantially equal to that of the cathode 40 of FIGS. 2 and 3. Thus, the actual electron-emitting regions 23,23' are situated at the area of openings 28,28' in an insulating layer 25, which covers a major surface 22,44.

In the p-type region 19 are formed pn junctions 29,29' between the p-type region 19 and n-type zones consisting of deep zones 31,31' and shallow zones 32,32'. At the area of the emitting regions 23,23', these pn junctions are situated between the shallow zones 32,32' and implanted p-type regions 33,33', which locally produce in situ a lower breakdown voltage. The dopings of the regions 33,33' are such that the pn junction 29' of the cathode 20' has a higher breakdown voltage than that of the cathode 20. As a result, during normal operation, the electron-emitting region 23 can emit electrons without emission of electrons occurring in the regions 23'. When a higher cut-off voltage is applied, the cathode 20' also starts to emit and a more intense electron beam is obtained, which can be used for bombardment and hence for an increase in efficiency of the cathode 40.

The second cathode 40, which in this embodiment entirely surrounds the first cathode, has practically the same construction as that of the semiconductor cathode 40 of the FIGS. 2 and 3. For a further description, reference may be made to the description of this cathode, while for corresponding parts the same reference numerals are used.

For contacting the various semiconductor zones, the insulating layer 25 is provided with contact holes 35,55 for contact metallizations 36,36' and 56, which contact the n-type zones 31, 31' and 51, respectively, and for contact metallizations 38 and 58, which contact the p-type regions 19 and 50, respectively.

Figure 7:
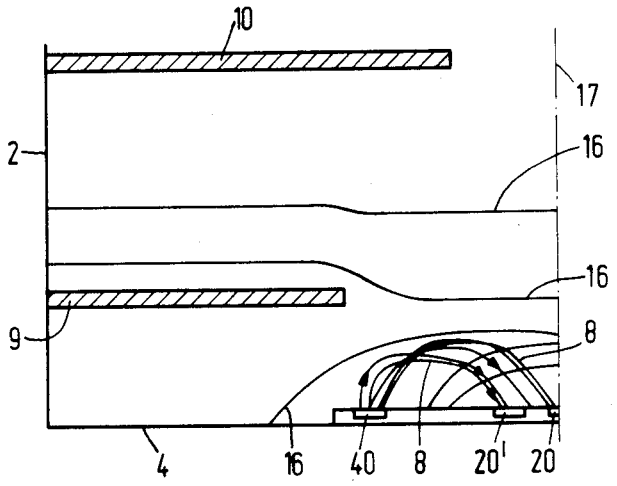
FIGS. 7 and 8 show potential lines and electron currents associated with the use of such a semiconductor device in arrangement according to the invention.

FIG. 7 shows potential lines 16 and the electron paths of the electron beam 8, while such voltages are applied to the cathodes of the arrangement shown in FIGS. 5, 6 and to a first grid 9 and a second grid 10 that the electron beam 8 originating from the cathode 40 strikes the electron-emitting region of the cathode 20 so that in this case an improvement in efficiency is obtained. This also applies to the cathode 20', which is also struck. FIG. 7 shows only a part of the cathode-ray tube 2, which part is further limited to a half cross-section (i.e from the axis 17). The grids 9 and 10 are situated at about 80 μm and about 200 μm, respectively, while they have voltages of 0 V and −600 V, respectively. The voltages at the cathodes 20 and 40 are 500 V and 0 V, respectively.

Figure 8:
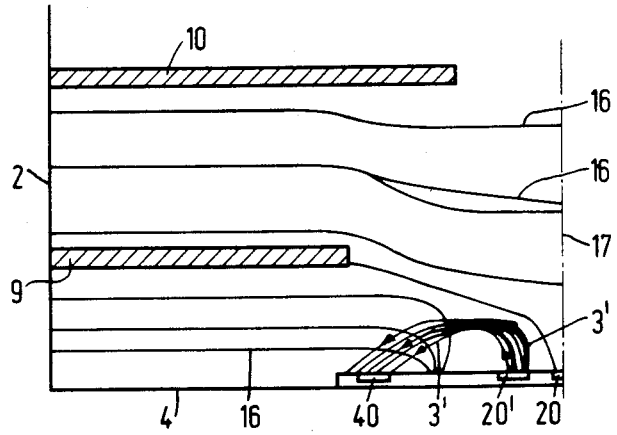

FIG. 8 shows the same arrangement, in which an electron beam 3' is produced by the cathode 20', which beam is deflected by the grids 9,10 to the cathode 40. The voltages at the cathodes 20' and 40 are now 0 V and 500 V, respectively, while the grids 9 and 10 have voltages of 0 V and −1500 V, respectively.

Of course the invention is not limited to the embodiments described herein, as various modifications are possible for those skilled in the art without departing from the scope of the invention. For example, it is not absolutely necessary to use silicon for the semiconductor body, but other semiconductor materials may also be used, such as, for example, silicon carbide or an $A^{III}$-$B^{V}$ compound, such as gallium arsenide. The p-type regions 19,50 and the n-type regions 31,31',51 may be contacted at several areas. This provides the possibility of subdividing, if required, these regions into subregions, which may be advantageous in connection with high voltages at the connection conductors. Furthermore, semiconductor cathodes operating according to a different principle may be used, such as cathodes operating according to the principle of negative electron affinity (NEA cathodes) or field emitters. Also it is not always necessary for the cathodes to be arranged in a vacuum space, but they may be mounted, for example, in a space containing an inert protective gas. An inert protective gas is to be understood to mean a gas which does not or does not influence the efficiency-increasing effect of an electron bombardment as described above.

What is claimed is:

1. A structure comprising a housing, the interior of said housing having one of an evacuated space and an inert protective gas-filled space, a semiconductor device within said housing for producing an electron beam and having a first cathode comprising a semiconductor body, said semiconductor body having at least one region for emitting electrons in the operating condition, a second cathode located in the vicinity of said first cathode and having an electron source for emitting electrons in the operating condition, and means for directing the electrons emitted from said second cathode electron source to strike said at least one region for emitting electrons in the semiconductor body of the first cathode.

2. A structure as claimed in claim 1, further comprising control means for concentrating the electrons generated by the second cathode in a beam which substantially strikes the electron-emitting region of the first cathode.

3. A structure as claimed in claim 1 or 2, wherein the second cathode comprises a semiconductor device comprising a second semiconductor body having, at a major surface, at least one region which emits electrons in the operating condition.

4. A structure as claimed in claim 3, characterized in that the first cathode and the second cathode face each other with their major surfaces and the semiconductor body in which the second cathode is realized is provided with an opening for passing the electrons generated by the first cathode.

5. A structure as claimed in claim 4, characterized in that, viewed in projection at right angles to the major surfaces, the opening is situated opposite to the electron-emitting region of the first cathode.

6. A structure as claimed in claim 3, characterized in that electron emission takes place at the major surface of the second cathode in at least a segment of an annular pattern.

7. A structure as claimed in claim 6, characterized in that the opening is substantially circular and is located concentrically with respect to the annular pattern.

8. A structure as claimed in claim 4, characterized in that the semiconductor body of the second cathode is provided at the side remote from the major surface with a metal layer.

9. A structure as claimed in claim 3, characterized in that the first cathode and the second cathode are formed in the same semiconductor body.

10. A structure as claimed in claim 9, characterized in that electron emission takes place at the major surface of the semiconductor body at the area of the second cathode in at least a segment of an annular pattern.

11. A structure as claimed in claim 10, characterized in that the electron-emitting region of the first cathode is located substantially concentrically with respect to the annular pattern.

12. A structure as claimed in claim 10, characterized in that the semiconductor body has an additional cathode and the structure is provided with control means which can concentrate the electrons generated by the additional cathode in a beam which strikes mainly the electron-emitting region of the second cathode.

13. A structure as claimed in claim 12, characterized in that the electron emission of the additional cathode takes place in at least a segment of an annular pattern which is located substantially concentrically with respect to the annular pattern of the first cathode.

14. A structure as claimed in claim 1 or 2, characterized in that at least one of the regions in which electron emission takes place is subdivided into separate electron-emitting regions having similar electrical connections for corresponding elements of the separate regions for a common operational adjustment.

15. A semiconductor device for use in a structure as claimed in claim 4, characterized in that the semiconductor device comprises a cathode comprising a semiconductor body, in which in the operating condition electron emission takes place in at least a segment of an annular pattern, which annular pattern surrounds an opening in the semiconductor body.

16. A semiconductor device as claimed in claim 15, characterized in that the opening, observed in plan view, is substantially circular and is located concentrically with respect to the annular pattern.

17. A semiconductor device for use in a structure as claimed in claim 9, characterized in that at least two separately-adjustable semiconductor cathodes are provided in the semiconductor body.

18. A semiconductor device as claimed in claim 17, characterized in that the first cathode has, at a major surface of the semiconductor body, an electron-emitting region which is located substantially concentrically with respect to an annular pattern, according to which pattern or part thereof the second cathode emits electrons.

19. A semiconductor device as claimed in claim 17, characterized in that the semiconductor body comprises an additional cathode, in which the electron emission takes place in an annular pattern or a segment of an annular pattern which is located substantially concentrically to the annular pattern of the second cathode.

20. A semiconductor device as claimed in claim 15, characterized in that at least one of the regions in which electron emission takes place is subdivided into separate electron-emitting regions having similar electrical connections for corresponding elements of the separate regions for a common operational adjustment.

* * * * *